US005943736A

United States Patent [19]

Kärkkäinen et al.

[11] Patent Number: 5,943,736

[45] Date of Patent: Aug. 31, 1999

[54] DOOR CLOSER

[75] Inventors: Vesa Kärkkäinen; Jaakko Junttila, both of Joensuu, Finland

[73] Assignee: Abloy Oy, Joensuu, Finland

[21] Appl. No.: 09/014,831

[22] Filed: Jan. 28, 1998

[30] Foreign Application Priority Data

Jan. 29, 1997 [FI] Finland ..... 970371

[51] Int. Cl.[6] ..... E05F 1/08

[52] U.S. Cl. ..... 16/79; 16/62; 16/69

[58] Field of Search ..... 16/79, 62, 69, 16/64, 58, 52, 53, DIG. 10, DIG. 9

[56] References Cited

U.S. PATENT DOCUMENTS

| | | | |
|---|---|---|---|
| 1,359,144 | 11/1920 | Angell | 16/68 |
| 4,744,125 | 5/1988 | Scheck et al. | 16/62 |
| 4,763,385 | 8/1988 | Furch et al. | 16/62 |

FOREIGN PATENT DOCUMENTS

| | | |
|---|---|---|
| 0 243 786 | 11/1987 | European Pat. Off. . |
| 0 350 568 | 1/1990 | European Pat. Off. . |
| 966 945 | 10/1950 | France . |
| 821772 | 3/1948 | Germany . |
| 2 008 666 | 6/1979 | United Kingdom . |

*Primary Examiner*—Chuck Y. Mah
*Attorney, Agent, or Firm*—Smith-Hill and Bedell

[57] ABSTRACT

A door closer includes a casing-like body enclosing a piston member, which is movable back and forth according to the movements of a door and is in cooperation with at least one closer spring, and a closer shaft and a pinion member connected thereto for transmitting the force of the movement of the door to the piston member. The pinion member is mounted on the closer shaft eccentrically with respect to its rolling curve. The piston member is casing-like and is provided with a toothing arranged at its inner surface. The rolling curve of the piston's toothing is at least substantially linear and is inclined relative to the axis of movement of the piston member. The pinion member is located inside the piston member in cooperation with the toothing of the piston member so that the force transmission moment of the pinion member is at its maximum in a position corresponding to the closed position of the door.

5 Claims, 1 Drawing Sheet

DOOR CLOSER

BACKGROUND OF THE INVENTION

This invention relates to a closer mechanism, for urging a pivotally mounted wing member such as a door from an open position toward a closed position.

Compact size and simple form of a door closer is of advantage from the viewpoint of both the installation of the door closer and its outer appearance. In this respect an advantageous solution can be provided when a casing-like piston is utilized, to which force transmission occurs through a pinion arranged on a closer shaft located inside the piston. This kind of solution is disclosed for instance in the publication GB 2008666.

From the viewpoint of the operation of a door closer, for its part, it would be of advantage that the door could be opened by exerting a force of reasonable size and yet closing of the door could still be ensured. For this purpose different hydraulic arrangements and closer spring solutions may be utilized. In practice, however, these are rather complicated and often unsatisfactory as to their operation. In this respect utilization of an eccentric pinion provides a more simple solution, whereby the lever arm of the moment transmitted by the pinion changing during the opening movement of the door together with the changing force of the closer spring makes an advantageous operation of the door closer possible. Patent publication DE 821772 discloses one solution of this kind, which, however, is unsatisfactory especially from the viewpoint of utilization of space. Another solution is disclosed in patent publication EP 243786. In this case the drawbacks include manufacturing problems and costs caused by differently shaped teeth.

SUMMARY OF THE INVENTION

An aim of the invention is to provide a new solution, which is constructionally simple and operationally advantageous from the viewpoint of force transmission and from which the drawbacks apparent in the above mentioned solutions have been eliminated.

In accordance with the invention the piston member is hollow, defining an interior cavity, and is provided with a toothing arranged at the inner surface thereof, the rolling curve of which is at least substantially linear and which is arranged transversely relative to the axis of movement of the piston member. In addition a pinion member is located in the interior cavity of the piston member in cooperation with the toothing of the piston member so that the force transmission moment of the pinion member is at its maximum in a position corresponding to the closed position of the door or other wing member. In this way power is provided for the closing moment of the door, even if the closer spring is in this phase not compressed more than to the extent of prestress, whereby also a closer spring with correspondingly smaller spring force is suitable for the purpose. On the other hand in the opening position of the door when approaching it the force transmission moment transmitted by the pinion member can be arranged to be much smaller at the same time as the compressive stress of the closer spring has been increased, whereby closing of the door can also at the beginning thereof be reliably accomplished.

The solution according to the invention provides also a door closer with advantageous size and form. In addition the solution makes it possible that the toothing of both the pinion member and of the piston member can be implemented as a standard toothing, which is of advantage from the viewpoint of manufacturing technique. The meshing angle between the pinion member and the piston member in the solution according to the invention, to be sure, does not remain theoretically quite correct, but changes somewhat within the range of the movement, whereby the clearance between the pinion member and the toothed rack in the piston member changes at the same time. In practice, however, this matter has no essential significance, since the obliquity of the toothed rack in the piston member compensates for the change. When needed this matter can also be influenced by providing the teeth with suitable shape, by optimizing the number of teeth utilized as well as by selecting materials so as to improve the strength of the teeth.

The angle between the linear rolling curve of the toothing in the piston member and the direction of movement of the piston member is with advantage selected to be in the range 4.5–7.2°. In practice for larger door closers intended for doors with relatively large mass or for example for doors in windy locations the angle is selected to be in the range 4.5–6.5°, preferably 5.5–6.2°. Hereby a compact solution is obtained, which is more advantageous from the viewpoint of the requirements for the strength of materials. In smaller door closers intended for doors with relatively small mass, in which the requirements for the strength of materials are correspondingly smaller, the angle may with advantage be selected to be 6.5–7.2°, whereby a greater change in the force transmission moment can be obtained. Naturally the change of the angle must be taken account of also in the eccentricity of the pinion member so that a bigger value for the angle corresponds to a larger eccentricity.

From the viewpoint of manufacturing technique it is of advantage, if the rolling curve of the pinion member has at least substantially the form of a circle or of a circular arc.

BRIEF DESCRIPTION OF THE DRAWINGS

In the following the invention is described by way of example with reference to the attached drawing, in which.

DETAILED DESCRIPTION

Figure 1:
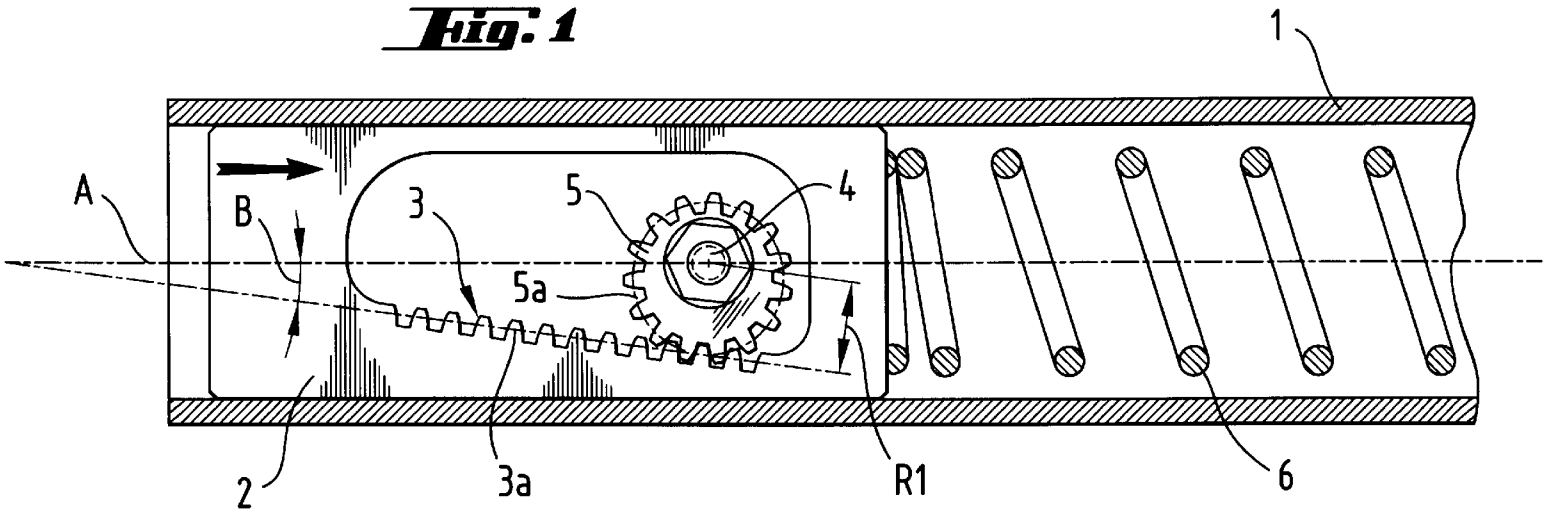
FIG. 1 shows a door closer according to the invention in an operational position corresponding to the closed position of a door.
Figure 2:
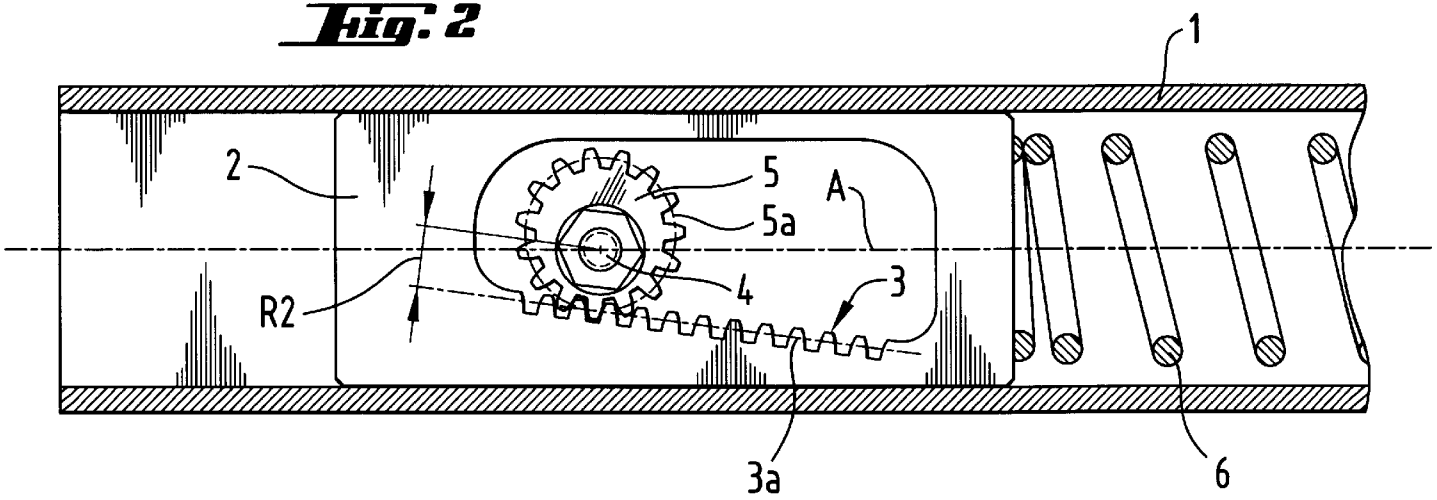
FIG. 2 shows the door closer of FIG. 1 in an operational position corresponding to the open position of a door.

In the drawing 1 indicates a casing-like cylinder body of a door closer enclosing a piston 2, which is in force transmission connection with a door or other wing member (not shown) which is pivotally mounted in a frame so that when the door is opened the piston 2 moves from the position of FIG. 1 in the direction of the arrow against the force of a closer spring 6 into the position of FIG. 2. The piston 2 is hollow and defines an interior cavity which provides a chamber for hydraulic fluid. The force transmission is accomplished by means of a pinion member 5 mounted on a closer shaft 4 journalled in the cylinder body 1 and a toothing 3 in the piston 2.

The force transmission moment that is applied to the closer shaft by the pinion and is transmitted to the door depends on the lever arm with which the piston 2 acts on the pinion and the force exerted on the piston by the spring 6.

As is apparent from FIGS. 1 and 2 the rolling curve 3*a* of the toothing 3 of the piston forms an angle B with an axis A along which the piston 2 moves in the cylinder body. The pinion member 5 has a circular rolling curve 5*a* and is mounted on the closer shaft 4 eccentrically with respect to its rolling curve 5*a*. As a consequence thereof in the situation of FIG. 1, in which the door is in the closed state, the lever arm R1 of the force transmission moment to be transmitted by the pinion member 5 is substantially bigger than the corresponding lever arm R2 of the force transmission moment in the situation of FIG. 2 when the door is open. This allows the force transmission moment to be changed independently of the compression force of the closer spring 6 in each case, which is of advantage from the viewpoint of the operation of the door closer.

Changing of the lever arm of the force transmission moment from R1 to R2 illustrates at the same time the change of the distance between the closer shaft 4 and the rolling curve 3*a* of the piston, which is compensated by arranging the rolling curve 3*a* at the angle B with respect to the axis of movement A of the piston. As recited already above, by means of this arrangement it is not possible to provide an equal theoretically ideal rolling situation between the toothing of the members 3 and 5 as when the distance in question remains unchanged. The arrangement, however, is advantageous from the viewpoint of force transmission and the problems relating to the strength of materials can be managed by selection of the materials as well as by utilizing a different angle B in closers of different size, so that in larger door closers, for controlling heavier doors, smaller values are used for the angle B. The angle B may then with advantage be for instance 5.8°, whereby the eccentricity of the pinion member 5 can be 1.5 mm. In smaller closers, in which the requirements for the strength of materials are correspondingly smaller as well, for instance the value 6.6° may be used for the angle B, whereby the eccentricity of the pinion member 5 is with advantage 2 mm. This arrangement provides a more advantageous change in the moment lever arm, but from the viewpoint of the strength of the materials it is somewhat less advantageous an arrangement.

Generally, the spring is stiffer in a door closer for a heavier door whereas the spring is less stiff in a door closer for a lighter door. When the angle B is smaller, the rolling friction between the teeth is reduced. In the case of a lighter door, when the spring is weaker, the angle B may be larger without adversely affecting the rolling friction between the teeth.

A compact arrangement is provided by virtue of the toothing 3 being on the inner surface of the hollow piston 2. Because the axis of the closer shaft 4 intersects the axis of movement A of the piston, the same piston member can be used in a closer for a left hand door and in a closer for a right hand door, simply by turning the piston around.

The invention is not limited to the embodiment shown, but several modifications are feasible within the scope of the accompanying claims.

We claim:

1. A closing device for urging a pivotally mounted wing member to move relative to a frame from an open position toward a closed position, said closing device including:

a cylinder body member, a piston member movable back and forth along a displacement axis defined by the cylinder body member, the piston member having an interior cavity and a toothing at an inner surface of said interior cavity, the toothing having a substantially linear rolling curve which is inclined relative to said displacement axis, a spring urging the piston member in one direction along said displacement axis, a closer shaft for transmitting force to the wing member to bring about pivotal movement thereof, a pinion member connected to the closer shaft, the pinion member being located in the interior cavity of the piston member and meshing with the toothing of the piston member, and the pinion member having a rolling curve which has at least substantially the form of a circle or a circular arc and is eccentric relative to the closer shaft, whereby the piston member acts on the closer shaft through a lever arm which is at a maximum when the wing member is in its closed position and decreases as the wing member is moved toward its open position.

2. A closing device according to claim 1, wherein the rolling curve of the toothing in the piston member is inclined to the axis of movement of the piston member at an angle in the range 4.5–7.2°.

3. A closing device according to claim 1, wherein the rolling curve of the toothing in the piston member is inclined to the axis of movement of the piston member at an angle in the range 4.5–6.5°.

4. A closing device according to claim 3, wherein the rolling curve of the toothing in the piston member is inclined to the axis of movement of the piston member at an angle in the range 5.5–6.2°.

5. A closing device according to claim 1, wherein the rolling curve of the toothing in the piston member is inclined to the axis of movement of the piston member at an angle in the range 6.5–7.2°.

* * * * *